US007060941B1

(12) United States Patent
Embury et al.

(10) Patent No.: US 7,060,941 B1
(45) Date of Patent: Jun. 13, 2006

(54) METHOD FOR BAKING A DESSERT USING STEAM

(75) Inventors: Karen M. Embury, St. Joseph, MI (US); Joel M. Sells, Hartford, MI (US); Stefania Fraccon, Varese (IT); Tamara Distaso, Gemonio (IT)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 11/110,382

(22) Filed: Apr. 20, 2005

(51) Int. Cl.
*A21D 8/06* (2006.01)
*A21B 1/24* (2006.01)

(52) U.S. Cl. ..... 219/401; 99/331; 99/468; 426/510

(58) Field of Classification Search ..... None
See application file for complete search history.

(56) References Cited

U.S. PATENT DOCUMENTS

| | | | | |
|---|---|---|---|---|
| 3,518,949 | A | 7/1970 | Stock | |
| 4,058,635 | A | 11/1977 | Durth | 426/509 |
| 5,075,120 | A * | 12/1991 | Leary et al. | 426/510 |
| 5,318,792 | A * | 6/1994 | Tippmann | 426/510 |
| 5,367,145 | A * | 11/1994 | Takagi | 99/325 |
| 5,494,690 | A | 2/1996 | Shelton | 426/233 |
| 5,619,983 | A * | 4/1997 | Smith | 99/331 |
| 5,631,033 | A | 5/1997 | Kolvites | 426/233 |
| 5,768,982 | A | 6/1998 | Violi et al. | 99/476 |
| 6,035,763 | A | 3/2000 | Yung | 99/348 |
| 6,175,100 | B1 | 1/2001 | Creamer et al. | 219/401 |
| 6,318,246 | B1 | 11/2001 | Fukushima et al. | 99/330 |
| 6,497,907 | B1 | 12/2002 | Hofer | 426/233 |
| 6,545,251 | B1 | 4/2003 | Allera et al. | 219/394 |
| 6,572,911 | B1 * | 6/2003 | Corcoran et al. | 426/510 |
| 6,773,738 | B1 | 8/2004 | Berger et al. | 426/510 |
| 2006/0000821 | A1 * | 1/2006 | Gerola et al. | 219/401 |

FOREIGN PATENT DOCUMENTS

| | | |
|---|---|---|
| EP | 0 233 535 | 8/1987 |

* cited by examiner

*Primary Examiner*—Joseph Pelham
(74) *Attorney, Agent, or Firm*—John F. Colligan; Robert O. Rice; Stephen Krefman

(57) ABSTRACT

A method of baking a dessert using steam in an automated household oven comprises a first heating step where a heating system preheats a cooking cavity to a first temperature at a first heating rate and a second heating step where the heating system preheats the cooking cavity from the first temperature to a second temperature at a second heating rate less than the first heating rate. The first temperature is preferably about the boiling point of water, and a steam system introduces steam into the cooking cavity to facilitate baking of the dessert after the cooking cavity reaches the first temperature. A convection fan of the heating system is active during the first and second heating steps to help circulate air and steam in the cooking cavity and becomes inactive later in the baking method.

23 Claims, 6 Drawing Sheets

| Stage | Time (minutes) | Temperature (°F) | Upper Heating Element Duty Cycle | Lower Heating Element Duty Cycle | Convection Fan | Boiler Duty Cycle |
|---|---|---|---|---|---|---|
| 1 | 4 | ~ 212 | 65 | 100 | On | 0 |
| 2 | 6 | ~ 248 | 35 | 65 | On | 100 |
| 3 | 6 | Set temperature | 35 | 65 | On | 80 |
| 4 | 15 | Set temperature | 35 | 65 | Off | 0 |
| 5 | Variable | Set temperature | 35 | 60 | Off | 0 |

Fig. 6

METHOD FOR BAKING A DESSERT USING STEAM

BACKGROUND OF THE INVENTION

1. Field of the Invention

The invention relates to a method for baking a dessert in an automated household oven using steam.

2. Description of the Related Art

Some types of desserts, especially delicate desserts, such as crème brulée and cheesecakes, benefit from steam baking. Introduction of steam into the baking cavity adds moisture to the dessert and slows down the cooking rate of the dessert to facilitate uniform heating and cooking. Steam acts as insulator or buffer to facilitate good heat transfer throughout the dessert. As a result, the steam prevents the outside of the dessert from overcooking and the inside of the dessert from undercooking.

Ovens found in most homes today are usually not equipped with a system to introduce steam into the oven cavity during the dessert baking process. In response, bakers have developed several home remedies for supplying steam into the oven cavity. Such remedies include surrounding the dessert with a water bath, placing a pan in the oven before preheating and filling the pan with water when placing the dessert in the oven, spraying water onto the walls of the oven with a spray bottle after the placing the dessert in the oven, and throwing ice cubes on the bottom of the oven to create steam. Another method involves forming holes in the bottom of a muffin tin, placing the tin on the bottom rack of the oven, filling the tin with boiling water about a minute before putting the dessert in the oven so the water drips onto the bottom of the oven and creates steam, and removing the tin after about five to ten minutes.

While the home remedies succeed at introducing steam into the oven cavity, they are relatively unpredictable and inconvenient. The water or ice introduced into the oven cavity vaporizes to create steam, which fills the oven cavity. The amount of steam in the oven can be quantified as a relative humidity, and the degree of relative humidity affects the dessert baking process. Because the water or ice is manually introduced, the quantity of steam and, therefore, the relative humidity, are not regulated, and, further, the relative humidity is not regulated as a function of the cooking cycle time. As a result, the relative humidity in the oven cavity can differ from ideal conditions at various times during the baking process. Further, some the methods can require the baker to periodically check on the dessert and add more water or ice to the cavity if necessary. This process can be inconvenient to a baker who desires to leave the dessert unattended after placing the dessert in the oven. Some higher end contemporary ovens incorporate an automated steam generating system that can be used to bake the dessert. These ovens eliminate the need for the baker to manually introduce water or ice into the cavity.

SUMMARY OF THE INVENTION

A method of baking a dessert using steam according to one embodiment of the invention during a cooking cycle in an automated household oven with a cooking cavity, a heating system for heating the cooking cavity, and a steam system for introducing steam into the cooking cavity comprises a first heating step comprising preheating the cooking cavity to a first temperature at a first heating rate; a second heating step comprising preheating the cooking cavity from the first temperature to a second temperature at a second heating rate less than the first heating rate; and introducing steam into the cooking cavity.

The first temperature can be at least the boiling point of water. The first heating step can comprise flash heating the cooking cavity to the first temperature. The first heating rate can be about 35° F./minute.

The second heating step can comprise uniformly heating the cooking cavity to the second temperature. The second heating rate can be about 6° F./minute. The second temperature can be a temperature is just below a minimum desired steam cooking temperature. The minimum desired steam cooking temperature can be about 250° F. The second heating step can comprise reducing a duty cycle of at least one of an upper heating element and a lower heating element of the heating system to achieve the second heating rate. The duty cycle of the upper heating element can be less than the duty cycle of the lower heating element.

The introducing of the steam can occur during the second heating step. According to one embodiment, the introducing of the steam does not occur during the first heating step.

The method can further comprise a third heating step of heating the cooking cavity to a third temperature from the second temperature. The third temperature can be input by a user into a control panel of the oven. The cooking cavity can be maintained at a predetermined relative humidity during the third heating step. The predetermined relative humidity can be a maximum relative humidity for the oven.

The method can further comprise running a convection fan of the oven to circulate air in the cooking cavity during at least one of the first heating step, the second heating step, and the third heating step. The method can further comprise ceasing the running of the convection fan after the third heating step. The convection fan can remain off for a remainder of the cooking cycle after the third heating step.

The method can further comprise maintaining the cooking cavity at the third temperature until the end of the cooking cycle. The method can further comprise introducing a decreasing amount of steam into the cooking cavity after the maintaining of the predetermined relative humidity. The method can further comprise terminating the introducing of the decreasing amount of steam prior to the end of the cooking cycle.

The dessert can be in the cooking cavity during the first and second heating steps.

BRIEF DESCRIPTION OF THE DRAWINGS

In the drawings:

FIG. 6 is a table of exemplary parameters for implementation of the method of baking a dessert shown in FIGS. 4 and 5.

DESCRIPTION OF THE PREFERRED EMBODIMENT

Figure 1:
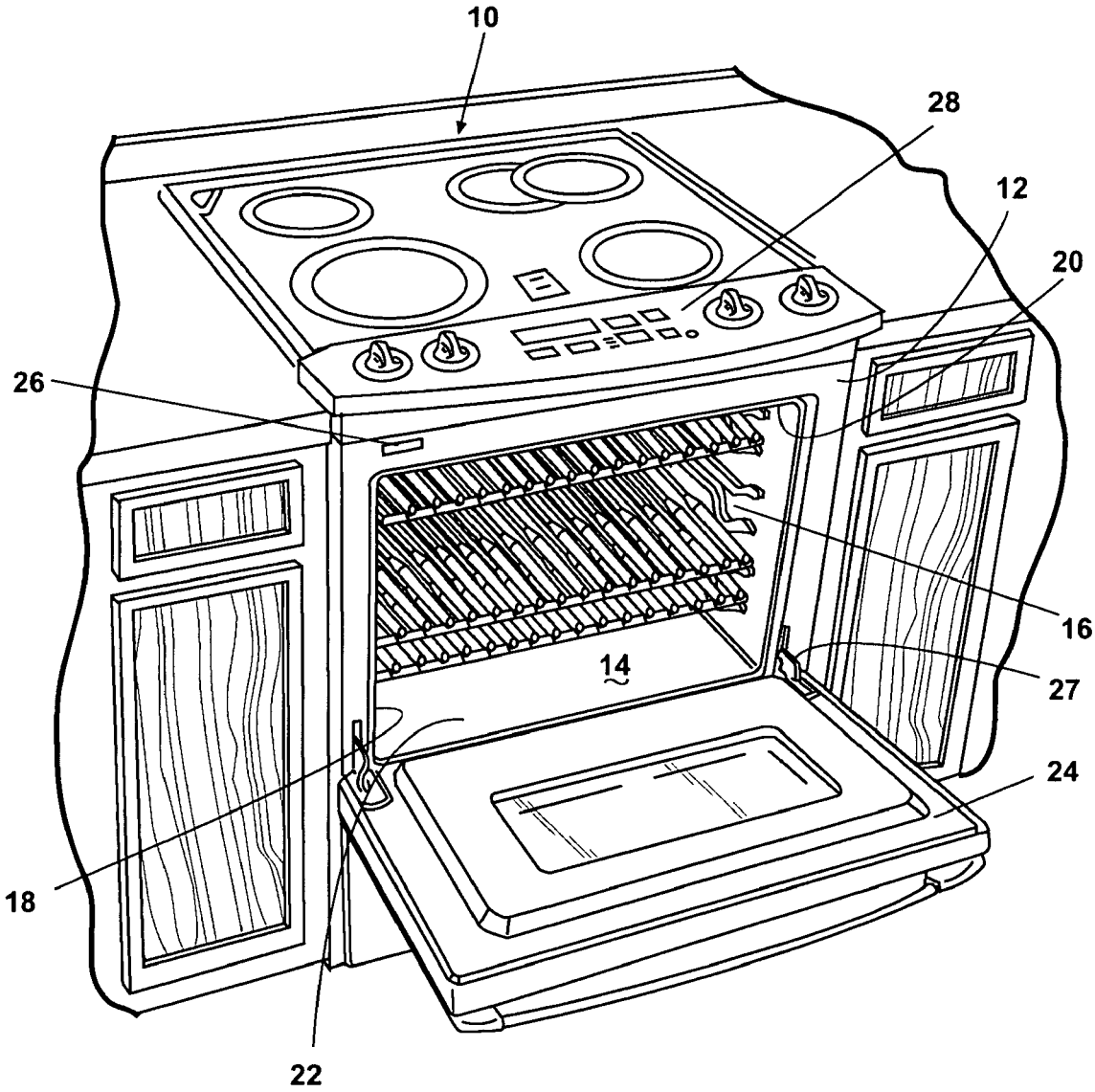
FIG. 1 is a perspective view of an exemplary automatic household oven.
Figure 2:
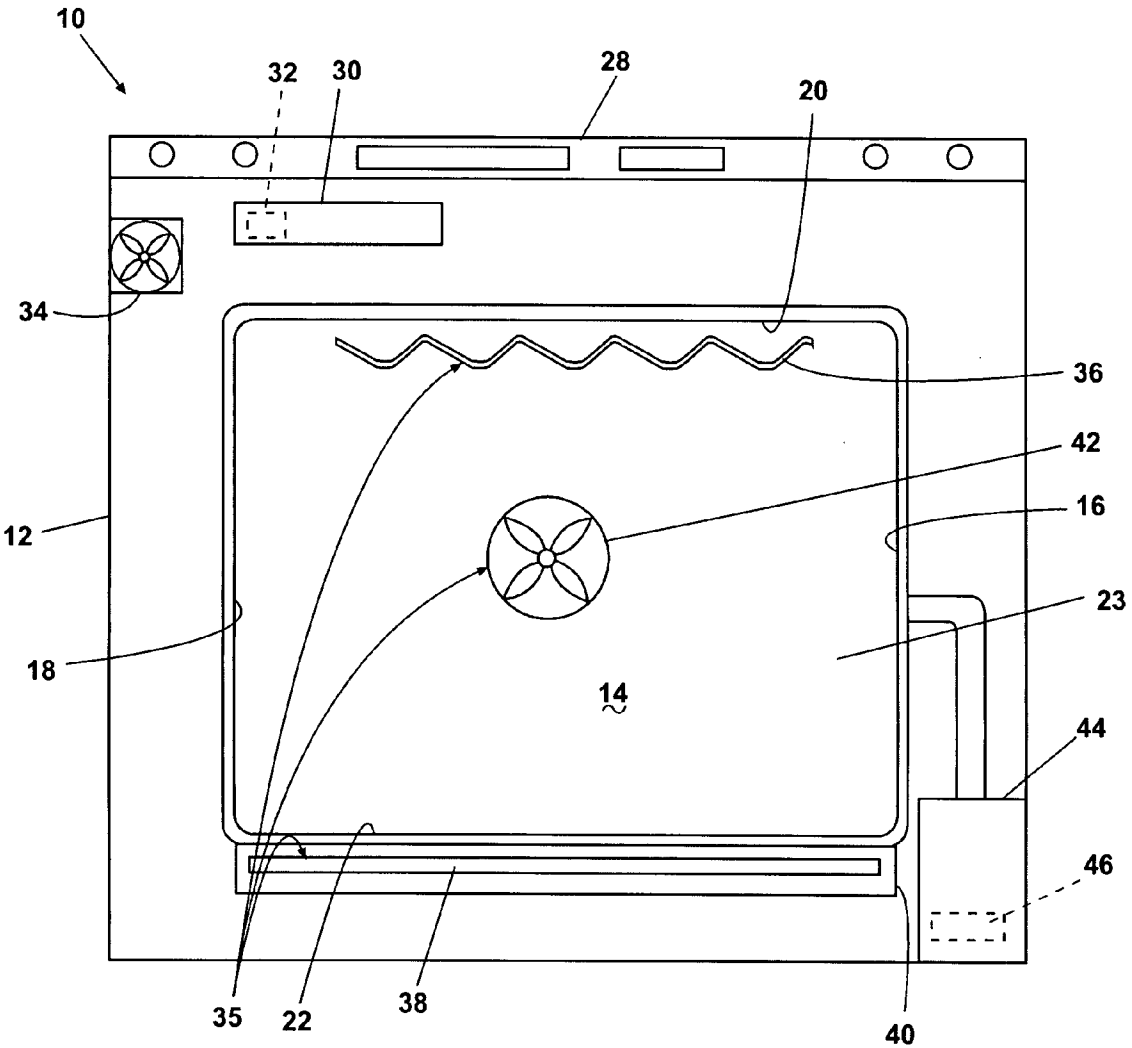
FIG. 2 is a schematic view of the oven of FIG. 1.

Referring now to the figures, FIG. 1 illustrates an exemplary automatic household oven 10 that can be used to implement a method for baking desserts with steam according to one embodiment of the invention. The oven 10 comprises a cabinet 12 with an open-face cooking cavity 14 defined by cooking cavity walls: a pair of spaced side walls 16, 18 joined by a top wall 20, a bottom wall 22, and a rear wall 23 (FIG. 2). A door 24 pivotable at a hinge 27 selectively closes the cavity 14, and a sensor 26 detects an open position of the door 24 and a closed position of the door 24. When the door 24 is in the open position, a user can access the cavity 14, while the door 24 in the closed position prevents access to the cavity 14 and seals the cavity 14 from the external environment.

The oven 10 further comprises a control panel 28 accessible to the user for inputting desired cooking parameters, such as temperature and time, of manual cooking programs or for selecting automated cooking programs. The control panel 28 communicates with a controller 30 located in the cabinet 12, as shown in FIG. 2. The controller 30 can be a proportional-integral-derivative (PID) controller or any other suitable controller, as is well-known in the automatic oven art. The controller 30 stores data, such as default cooking parameters, the manually input cooking parameters, and the automated cooking programs, receives input from the control panel 28, and sends output to the control panel 28 for displaying a status of the oven 10 or otherwise communicating with the baker. Additionally, the controller 30 includes a timer 32 for tracking time during the manual and automated cooking programs and a cooling fan 34 located in the cabinet 12 for drawing cooling air into the cabinet 12 and directing the air toward the controller 30 to avoid overheating of the controller 30 by heat conducted from the cavity 14. The cooling air flows around the outside of the cooking cavity walls 16, 18, 20, 22, 23.

With continued reference to FIG. 2, the oven 10 further comprises a heating system 35 having an upper heating element 36, commonly referred to as a broiler, and a lower heating element 38. The schematic illustration of the FIG. 2 shows the lower heating element 38 as being hidden or mounted beneath the cooking cavity bottom wall 22 in a heating element housing 40. Heat from the lower heating element 38 conducts through the bottom wall 22 and into the cavity 14. Alternatively, the lower heating element 38 can be mounted inside the cavity 14, as is well-known in the oven art. Further, the upper and lower heating elements 36, 38 can be mounted at the side walls 16, 18 of the cavity 14, as disclosed in U.S. Pat. No. 6,545,251 to Allera et al., which is incorporated herein by reference in its entirety. The heating system 35 according to the illustrated embodiment further comprises a convection fan 42 that circulates air and steam, when present, within the cavity 14. The convection fan 42 can be any suitable fan and can be mounted in any suitable location of the cavity 14, such as in the rear wall 23.

In addition to the heating system, the oven 10 comprises a steam system 44 preferably mounted within the cabinet 12 and configured to introduce steam into the cavity 14. The steam system 44 in the illustrated embodiment comprises a boiler 46 that heats water stored in the steam system 44. However, the steam system 44 can be any suitable system that is capable of introducing steam directly into the cavity 14 or introducing water that is turned into steam in the cavity 14 and is not limited to the system shown schematically in FIG. 2.

Figure 3:
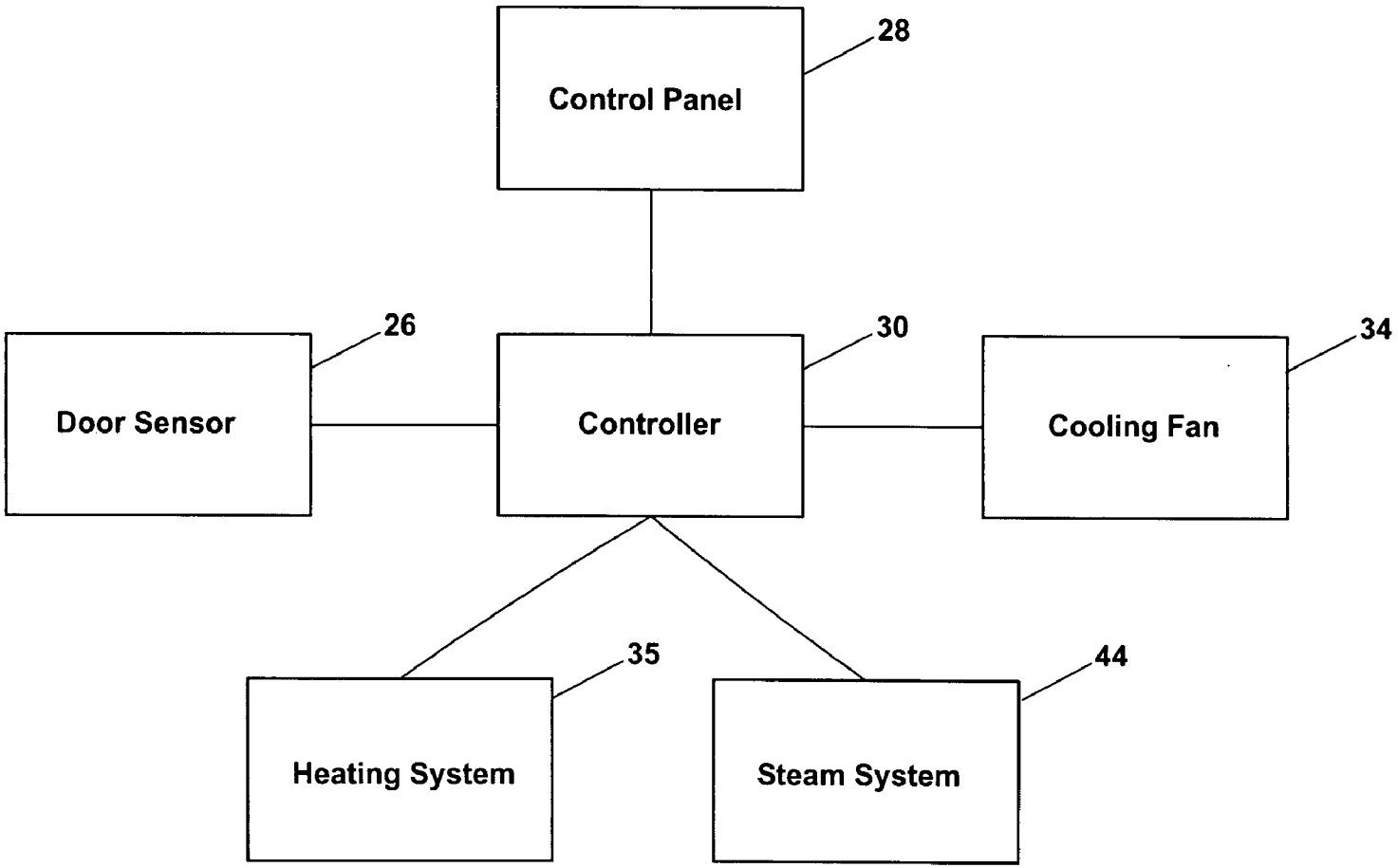
FIG. 3 is a schematic diagram illustrating a controller of the oven of the FIG. 1 and exemplary components in operative communication with the controller for executing a method of baking a dessert according to one embodiment of the invention.

FIG. 3 is a block diagram that schematically illustrates a control system of the oven 10. The control system comprises the controller 30, which operably communicates with the control panel 28, as described above, the door sensor 26, the cooling fan 34, the heating system 35, and the steam system 44. The door sensor 26 communicates to the controller 30 the open or closed position of the door 24, and the controller 30 communicates with the cooling fan 34 to activate or deactivate the cooling fan 34 to control the temperature of the controller 30. The controller 30 instructs the heating system 35 to activate or deactivate the upper heating element 36, the lower heating element 38, and the convection fan 42, either all together, individually, or in groups, and provides instructions regarding the desired temperature of the cavity 14 and the rate at which the heating system 35 heats the cavity 14. Similarly, the controller 30 instructs the steam system 44 to activate or deactivate the boiler 46 and provides instructions regarding the desired temperature of the water in the steam system 44 in order to achieve the desired relative humidity in the cavity 14.

As stated above, the exemplary oven 10 can be used to implement a method 50 of baking a dessert with steam according to one embodiment of the invention. The method 50 comprises several stages during which the heating system 35 operates to control a temperature of the cavity 14 and the steam system 44 operates to control a relative humidity of the cavity 14. The temperature and the relative humidity during the stages are selected to produce a dessert having desired outer and inner characteristics, such as texture and color. As used herein, the term "dessert" refers to any type of dessert that benefits from steam baking. Examples of desserts include, but are not limited to, delicate desserts, such as crème brulée, cheesecakes, pies, custards, and soufflés. Furthermore, the method for baking a dessert according to the invention is also useful for cooking egg and cheese dishes, such as quiches.

Figure 4:
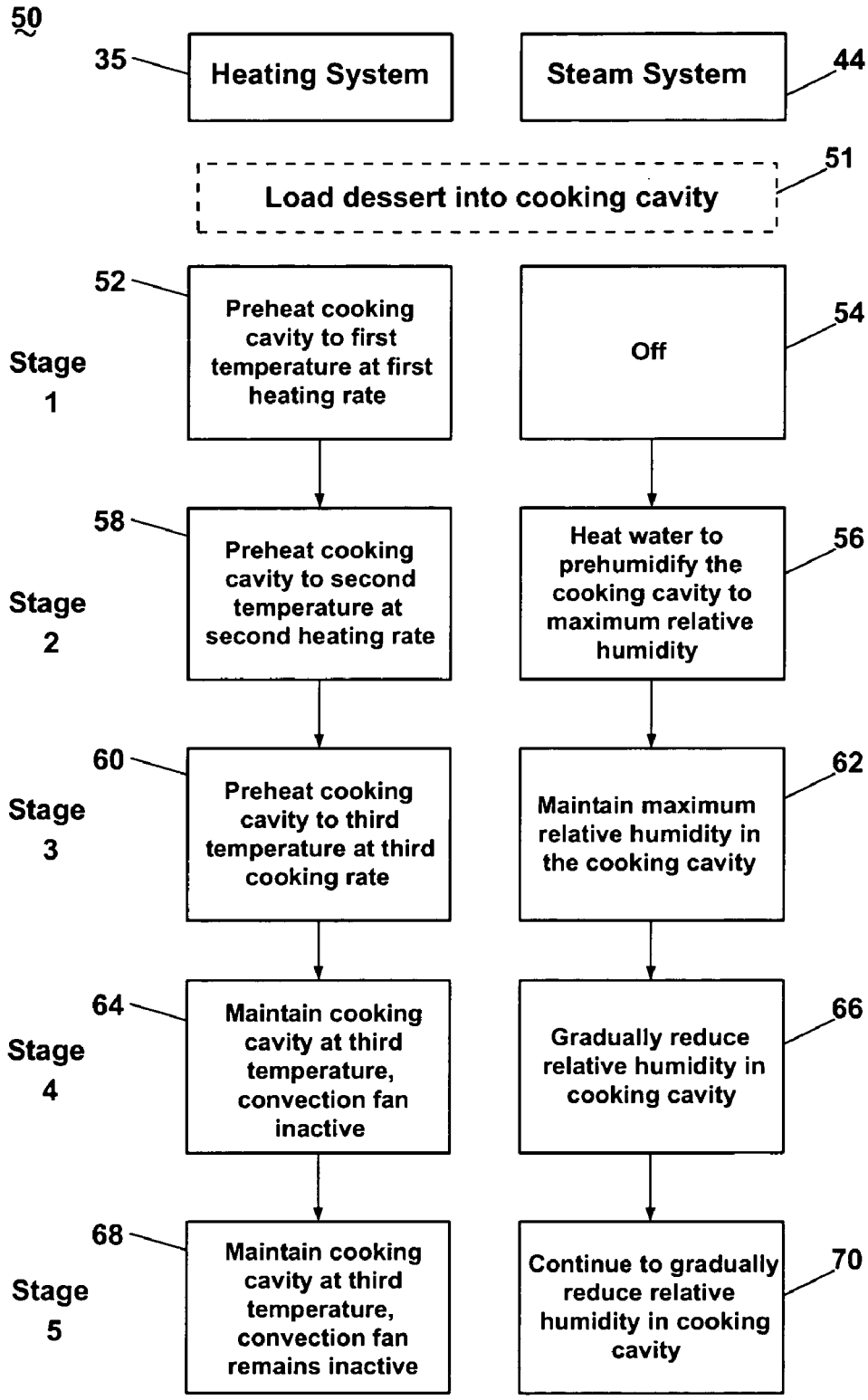
FIG. 4 is a schematic diagram illustrating a method of baking a dessert according to one embodiment of the invention.
Figure 5:
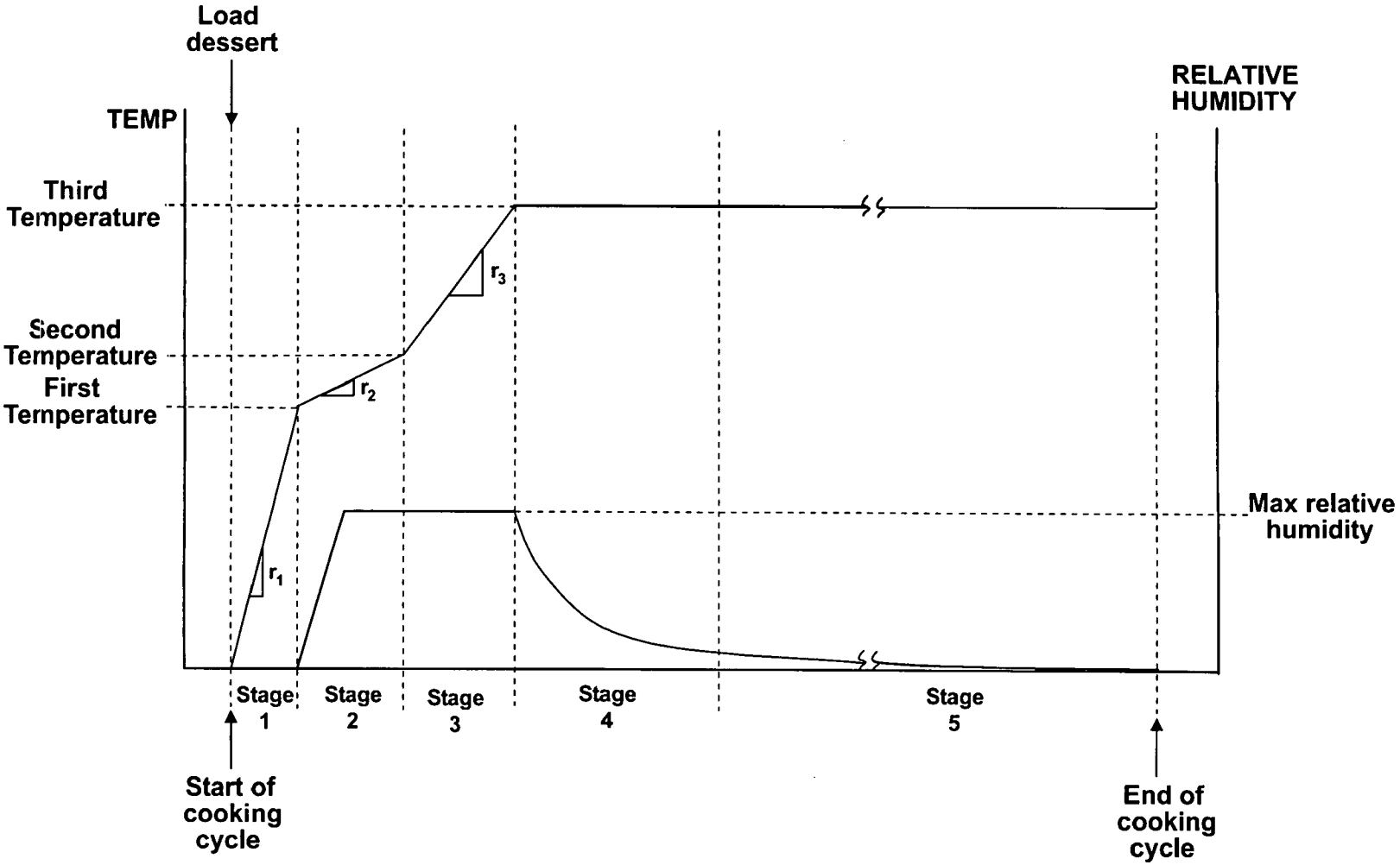
FIG. 5 is a schematic graph illustrating a temperature and a relative humidity in a cooking cavity of the oven of FIG. 1 during the execution of the method of baking a dessert shown in FIG. 4.

The stages of the method 50 according to one embodiment of the invention are shown in a flow chart in FIG. 4, which presents the functions of the heating system 35 and the steam system 44 during each stage of the method 50, and the corresponding temperature of the cavity 14 and the relative humidity of the cavity 14 for the stages are schematically illustrated in FIG. 5. FIG. 5 is not intended to report actual behavior of the temperature and the relative humidity during the method 50; rather, FIG. 5 represents a general behavior of these properties. It will be apparent to one of ordinary skill in the oven art that, in reality, the actual temperature and the actual relative humidity fluctuate about a target temperature and a target relative humidity during the operation of an oven.

Before the first stage of the method 50, the baker prepares the dessert and places the dessert and a corresponding dessert support, such as a baking stone or a baking tray, if used, into the cavity 14, as indicated by step 51 in FIG. 4. In general, stage 1 can be referred to as a dry preheat stage where the heating system 35 heats the cavity 14 to a first temperature at a first heating rate $r_1$ (step 52), and the steam system 44 is off or not activated (step 54). According to one embodiment of the invention, the first temperature is a temperature about equal to the boiling point of water. The first temperature is at least equal to about the boiling point of water so that steam entering the cavity 14 during stage 2 will maintain a vapor phase (or water entering the cavity 14 will undergo a phase change to vapor, if the steam system 44 introduces water into the cavity 14), as will be discussed in more detail below with respect to stage 2. The first heating rate is relatively high so as to flash heat the cavity 14 whereby the cavity 14 quickly reaches the first temperature. Flash heating comprises heating the cavity 14 rapidly, such as by heating the cavity 14 as fast as possible or at a rate to minimize the time required for the cavity 14 to reach the first temperature. Stage 1 terminates when the cavity 14 reaches the first temperature or after a predetermined period of time.

Stage 2 follows stage 1 and can be generally referred to as a prehumidfy stage where the steam system 44 activates to heat the water, such as by the boiler 46, to prehumidify the cavity 14 (step 56) while the heating system 35 continues to preheat the cavity 14. Waiting until the end of stage 1 to initiate the steam system 44 ensures that the temperature of the cavity 14 is high enough to sustain steam in a vaporized state. As a result, the vapor will not condense in the cavity 14 and form water droplets on the walls 16, 18, 20, 22, 23, the dessert, or any other items in the cavity 14. Formation of water droplets on porcelain, which is a material found on the cavity walls 16, 18, 20, 22, 23 of many ovens, can undesirably damage the material. When the water in the steam system 44 reaches its boiling point, the steam begins to enter the cavity 14 and raises the relative humidity in the cavity 14. According to one embodiment of the invention, the relative humidity of the cavity 14 reaches a maximum relative humidity during stage 2 or at least by the end of stage 2. Thus, by the end of stage, 2, the cavity 14 is moist, a condition where the relative humidity of the cavity 14 is greater than the relative humidity of the cavity 14 prior to the introduction of steam and is at a level desired for initial baking of the dessert. Concurrently, the heating system 35 raises the temperature of the cavity 14 to a second temperature at a second heating rate $r_2$ less than the first heating rate (step 58). According to one embodiment of the invention, the second temperature is just below a minimum desired steam baking temperature, as will be discussed in more detail hereinafter. The second heating rate is relatively low so that the temperature of the cavity 14 slowly approaches the second temperature to avoid exposing the dessert to excessive direct radiation and to ensure that the cavity 14 is uniformly heated. The term "uniformly heated" refers to all spaces and walls 16, 18, 20, 22, 23 of the cavity 14 and items, such as baking racks, baking stones, and baking trays, in the cavity 14 achieving the first temperature. A uniformly heated cavity results in a higher quality dessert item with consistent final characteristics. When the cavity 14 is uniformly heated and the baker opens and closes the door 24, the temperature of the cavity 14 almost immediately returns to the temperature of the cavity 14 prior to the opening of the door 24.

When stage 2 ends, either upon the cavity 14 reaching a desired relative humidity, such as the maximum relative humidity, or the second temperature, or after a predetermined period of time, stage 3 begins. During stage 3, the heating system 35 increases the temperature of the cavity 14 to a third temperature (step 60) at a third heating rate $r_3$ optionally greater than the second heating rate and less than the first heating rate, and the steam system 44 maintains the desired or maximum relative humidity (step 62). According to one embodiment of the invention, the third temperature is equal to a set temperature, which can be a temperature entered by a user through a user interface on the control panel 28 or set by the automatic cooking program, and is at least equal to the minimum desired steam baking temperature. The user interface can comprise, for example, a button, a touch pad, a touch screen, or a voice command unit.

When the temperature of the cavity 14 reaches the third temperature or after a predetermined period of time, stage 4 begins. During stage 4, the heating system 35 maintains the temperature of the cavity 14 at the third temperature (step 64), and the steam system 44 decreases and/or terminates steam production. Because the amount of steam generated by the steam system 44 decreases or ceases while steam in the cavity 14 is lost through vents, the relative humidity of the cavity 14 gradually decreases (step 66). Further, during stage 4, the convection fan 42 ceases operation, as indicated in step 64. The convection fan 42 is active during the preceding stages to help distribute the air and steam throughout the cavity 14, but at this stage, the convection fan 42 is no longer needed. Ceasing operation of the convection fan 42 avoids an excessively rapid cooking rate and an undesired premature formation of a skin or crust on the outer surface of the dessert.

After a predetermined period of time, stage 4 ends and stage 5 begins. Operationally, stages 4 and 5 are substantially identical in that the heating system 35 maintains the cavity 14 at the third temperature (step 68) while the steam system 44 continues to decrease and/or terminates steam production (step 70). Again, because the amount of steam generated by the steam system 44 decreases or ceases while steam in the cavity 14 is lost through vents, the relative humidity of the cavity 14 gradually decreases. Steam requirements for the dessert reduce over the course of the cooking cycle, and by the end of stage 5, the cavity 14 is uniformly hot and relatively dry, a condition where the relative humidity of the cavity 14 is relatively lower than the moist condition and is at or near the relative humidity of the cavity 14 prior to the introduction of steam. The duration of stage 5 can be variable and dependent on a user input cooking cycle time. In this circumstance, the duration of stage 5 is equal to the user input cycle time less the combined duration of stages 1–4. If the user input cycle time is less than the combined duration of stages 1–4, stage 5 can be eliminated, and the duration of stage 4 can be adjusted in accordance with the user input cycle time. Alternatively, the duration of stage 5 can be set by an automatic cooking cycle.

An exemplary implementation of the method 50 with the oven 10 described above, along with exemplary operational parameter values, is presented below, with it being understood that the method 50 can be utilized with any suitable household oven 10 and that the implementation of the method 50 with different ovens can differ according to the oven utilized. The exemplary operational parameter values are shown in a table in FIG. 6.

During stage 1, the heating system 35 rapidly heats the cavity 14 to about 212° F., the boiling point of water at sea level. As is well known in the chemistry art, the boiling point of water changes with altitude and solute content, and the first temperature can be adjusted accordingly. The duration of stage 1 is about 4 minutes; thus, the first heating rate is about 35° F. per minute if the cavity 14 reaches the 212° F. at the end of the 4 minutes. However, the cavity 14 can reach the first temperature before the end of the 4 minutes, if desired. The controller 30 instructs the heating system 35 to operate the upper heating element 36 at a 65% duty cycle and the lower heating element 38 at a 100% duty cycle and to activate the convection fan 42. An exemplary duty cycle is the percentage of time the heating element is on (i.e., power is supplied to the heating element) during a certain time interval, such as 1 minute. The duty cycle of the upper heating element 36 is lower than that of the lower heating element 38 to avoid overheating and excessively browning the exposed upper surface of the dessert that is already present in the cavity 14.

After the 4 minutes, stage 2 begins, and the controller 30 instructs the heating system 35 to reduce the duty cycles of the upper and lower heating elements 36, 38 to 35% and 65% duty cycles, respectively, to slowly increase the temperature to about 248° F. The duration of stage 2 is about 6 minutes; thus, the first heating rate is about 6° F. per minute if the temperature of cavity 14 reaches about 248° F. at the end of the 6 minutes. As with stage 1, the temperature in the cavity 14 can reach the second temperature prior to the end of the 6 minutes, if desired. Additionally, the steam system 44 communicates with the controller 30 and turns on the boiler 46 for operation at a 100% duty cycle to raise the relative humidity in the cavity 14 to the maximum relative humidity. As with the heating elements 36, 38, an exemplary duty cycle for the boiler 46 is the percentage of time the boiler 46 is on (i.e., power is supplied to the boiler 46) during a certain time interval, such as 1 minute.

During stage 3, the duty cycles of the upper and lower heating elements 36, 38 remain the same while increasing the temperature of the cavity 14 to the third temperature, which, according to one embodiment of the invention, is a set temperature. The set temperature is a temperature at which the dessert is baked following the preheating and usually ranges between about 250° F., the minimum desired steam baking temperature according to one embodiment of the invention, and 450° F. The second temperature from stage 2 can be adjusted accordingly if the minimum desired steam baking temperature differs from 250° F. The duration of stage 3 is about 6 minutes, and the cavity 14 can reach the set temperature before the end of the 6 minutes and at least by the end of the 6 minutes. Further, the duty cycle of the boiler 46 reduces so that the steam system 44 continues to make enough steam to replace steam lost through vents or other means and maintain the maximum relative humidity for the 6 minutes. The duty cycle can be reduced to about 80%.

After the 6 minutes of stage 3, stage 4, which has a duration of about 15 minutes, begins. During stage 4, the duty cycles of the upper and lower heating elements 36, 38 remain the same to maintain the temperature of the cavity 14 at the set temperature, while the controller 30 turns off the convection fan 42, as described above, to avoid an excessively rapid cooking rate and formation of a skin or crust. Further, the controller 30 deactivates the boiler 46 of the steam system 44 so that the boiler 46 discontinues heating of the water. As a result, the temperature of the water decreases, the amount of steam decreases, and the relative humidity of the cavity 14 gradually decreases to or near the relative humidity of the cavity 14 prior to the introduction of the steam in stage 2. Following stage 4, the controller initiates stage 5, which has a variable duration that depends on the user input cooking cycle time, as described above. Operationally, the only difference between stage 4 and stage 5 is that the duty cycle of the lower heating element 38 reduces to about 60%. The temperature of the water in the steam system 44 continues to decrease, and, as a result, the amount of steam continues to decrease, and the relative humidity of the cavity 14 continues to gradually return to or near the relative humidity of the cavity 14 prior to the introduction of the steam in stage 2.

As mentioned above, the operational parameter values shown in FIG. 6 are dependent on the oven 10 utilized to implement the method. Different ovens have different types of heating systems (e.g., some ovens do not have the convection fan 42) and steam systems, which affect the implementation of the method 50. For example, the above operational parameter values were determined with the cooling fan 34 operational during the entire cooking cycle. Because the cooling fan can draw away heat from the cooking cavity 14 though the cooking cavity walls 16, 18, 20, 22, 23, the cooling fan can affect the temperature of the cavity 14.

When the baker desires to bake a dessert using the method 50, the baker prepares the dessert, opens the door 24, places the dessert along with the dessert support, if used, in the cavity 14, and closes the door 24. Next, the user selects a "DESSERT" cooking cycle on the oven 10 through the control panel 28. The baker also enters the set temperature and the cooking cycle time, if needed, through the control panel 28. The oven 10 then implements the method 50, beginning at stage 1 and ending at stage 4 or stage 5. Following stage 5, the baker removes the dessert, which has the desired outer and inner characteristics, such as texture and color, from the cavity 14. Thus, the dessert is baked in a controlled steam environment, and the baker does not have to attend to the dessert during the baking process nor execute any dangerous home remedies to introduce steam into the cavity 14.

While the invention has been specifically described in connection with certain specific embodiments thereof, it is to be understood that this is by way of illustration and not of limitation, and the scope of the appended claims should be construed as broadly as the prior art will permit.

What is claimed is:

1. A method of baking a dessert using steam during a cooking cycle in an automated household oven with a cooking cavity, a heating system for heating the cooking cavity, and a steam system for introducing steam into the cooking cavity, the method comprising:

a first heating step comprising preheating the cooking cavity to a first temperature at a first heating rate;

a second heating step comprising preheating the cooking cavity from the first temperature to a second temperature at a second heating rate less than the first heating rate; and introducing steam into the cooking cavity.

2. The method according to claim 1, wherein the first temperature is at least the boiling point of water.

3. The method according to claim 2, wherein the first heating step comprises flash heating the cooking cavity to the first temperature.

4. The method according to claim 3, wherein the first heating rate is about 35° F./minute.

5. The method according to claim 3, wherein the second heating step comprises uniformly heating the cooking cavity to the second temperature.

6. The method according to claim 5, wherein the second heating rate is about 6° F./minute.

7. The method according to claim 5, wherein the second temperature is a temperature is just below a minimum desired steam cooking temperature.

8. The method according to claim 7, wherein the minimum desired steam cooking temperature is about 250° F.

9. The method according to claim 5, wherein the second heating step comprises reducing a duty cycle of at least one of an upper heating element and a lower heating element of the heating system to achieve the second heating rate.

10. The method according to claim 9, wherein the duty cycle of the upper heating element is less than the duty cycle of the lower heating element.

11. The method according to claim 1, wherein the introducing of the steam occurs during the second heating step.

12. The method according to claim 11, wherein the introducing of the steam does not occur during the first heating step.

13. The method according to claim 12 and further comprising a third heating step of heating the cooking cavity to a third temperature from the second temperature.

14. The method according to claim 13, where the third temperature is input by a user into a control panel of the oven.

15. The method according to claim 13 wherein the cooking cavity is maintained at a predetermined relative humidity during the third heating step.

16. The method according to claim 15, wherein the predetermined relative humidity is a maximum relative humidity for the oven.

17. The method according to claim 15 and further comprising running a convection fan of the oven to circulate air in the cooking cavity during at least one of the first heating step, the second heating step, and the third heating step.

18. The method according to claim 17 and further comprising ceasing the running of the convection fan after the third heating step.

19. The method according to claim 18, wherein the convection fan remains off for a remainder of the cooking cycle after the third heating step.

20. The method according to claim 15 and further comprising maintaining the cooking cavity at the third temperature until the end of the cooking cycle.

21. The method according to claim 20 and further comprising introducing a decreasing amount of steam into the cooking cavity after the maintaining of the predetermined relative humidity.

22. The method according to claim 21 and further comprising terminating the introducing of the decreasing amount of steam prior to the end of the cooking cycle.

23. The method according to claim 1, wherein the dessert is in the cooking cavity during the first and second heating steps.

* * * * *